US010351920B2

(12) United States Patent
Margaria et al.

(10) Patent No.: US 10,351,920 B2
(45) Date of Patent: Jul. 16, 2019

(54) INOCULANT WITH SURFACE PARTICLES

(71) Applicant: FERROPEM, Chambery (FR)

(72) Inventors: Thomas Margaria, Chambery (FR); Aurelie Fay, Albertville (FR)

(73) Assignee: PERROPEM, Chambery (FR)

( * ) Notice: Subject to any disclaimer, the term of this patent is extended or adjusted under 35 U.S.C. 154(b) by 507 days.

(21) Appl. No.: 14/778,842

(22) PCT Filed: Mar. 19, 2014

(86) PCT No.: PCT/FR2014/050636
§ 371 (c)(1),
(2) Date: Sep. 21, 2015

(87) PCT Pub. No.: WO2014/147342
PCT Pub. Date: Sep. 25, 2014

(65) Prior Publication Data

US 2016/0047008 A1 Feb. 18, 2016

(30) Foreign Application Priority Data

Mar. 19, 2013 (FR) ..... 13 52419

(51) Int. Cl.
*B22F 1/02* (2006.01)
*C21C 1/10* (2006.01)
(Continued)

(52) U.S. Cl.
CPC ..... *C21C 1/105* (2013.01); *B22F 1/02* (2013.01); *B22F 1/025* (2013.01); *C21C 7/0037* (2013.01);
(Continued)

(58) Field of Classification Search
CPC .. C21C 1/05; C21C 1/105; C21D 5/02; C22C 37/00; C22C 33/08; B22F 1/02;
(Continued)

(56) References Cited

U.S. PATENT DOCUMENTS 5,951,738 A * 9/1999 Dube ..... B22F 1/02 148/513
6,102,983 A * 8/2000 Skaland ..... C22C 33/08 420/33
(Continued)

FOREIGN PATENT DOCUMENTS

CN 102373361 A * 3/2012
DE 2157395 A1 * 5/1973 ..... B22F 1/0059
(Continued)

OTHER PUBLICATIONS

Yulin Liu et al. CN 102373361 A published Mar. 14, 2012. Machine translation.*
(Continued)

*Primary Examiner* — Tima M McGuthry-Banks
(74) *Attorney, Agent, or Firm* — Cantor Colburn LLP

(57) ABSTRACT

The present invention relates to a particulate inoculant for treating liquid cast-iron, comprising, on the one hand, support particles made of a fusible material in the liquid cast-iron, and on the other hand, surface particles made of a material that promotes the germination and the growth of graphite, disposed and distributed in a discontinuous manner at the surface of the support particles, the surface particles presenting a grain size distribution such that their diameter d50 is smaller than or equal to one-tenth of the diameter d50 of the support particles.

17 Claims, 2 Drawing Sheets

(51) Int. Cl.

| | |
|---|---|
| ***C21D 5/02*** | (2006.01) |
| ***C22C 33/08*** | (2006.01) |
| ***C22C 37/00*** | (2006.01) |
| ***C21C 7/00*** | (2006.01) |
| ***C22C 37/04*** | (2006.01) |
| ***C22C 37/08*** | (2006.01) |

(52) U.S. Cl.
CPC ..... *C21D 5/02* (2013.01); *C22C 37/00* (2013.01); *C22C 37/04* (2013.01); *C22C 37/08* (2013.01); *C21D 2211/006* (2013.01); *C22C 33/08* (2013.01)

(58) Field of Classification Search
CPC .. B22F 1/025; B22F 2301/00; B22F 2302/00; B22F 2303/00; B22F 2301/052; B22F 2301/35; B22F 2302/20
See application file for complete search history.

(56) References Cited

U.S. PATENT DOCUMENTS

| | | | | |
|---|---|---|---|---|
| 6,126,713 | A | 10/2000 | Igarashi et al. | |
| 9,833,838 | B2 * | 12/2017 | Mazyar | B22F 1/025 |
| 2006/0147790 | A1 * | 7/2006 | Zaghib | C09C 1/46 428/403 |
| 2014/0262327 | A1 * | 9/2014 | Xu | E21B 29/00 166/376 |

FOREIGN PATENT DOCUMENTS

| | | | |
|---|---|---|---|
| GB | 2064370 A | * | 6/1981 |
| WO | 9929911 A1 | | 6/1999 |

OTHER PUBLICATIONS

Skaland, T. "A New Method for Chill and Shrinkage Control in Ladle Treated Ductile Iron." Keith Millis Symposium on Ductile Cast Iron. allaboutmetallurgy.com/wp/wp-content/uploads/2017/08/New-Method-of-Control-for-Chill-and-Shrinkage-in-Ladle-treated-Ductile-Iron.pdf. (Year: 2003).*

DE 2157395 A1. Machine translation of the description. (Year: 1973).*

Schwartz, Harold. "ProKon." The Calculation Companion. Iron, Magnesium, Calcium, and Silicon. (Year: 1997).*

Eun-Hee Kim et al. "Dual coating process for a high functional reinforcement phase in metal matrix composites", Progress in Organic Coatings, Dec. 22, 2010, pp. 1-6, XP002628151.

International Search report dated Jul. 21, 2014 re: Application No. PCT/FR2014/050636; pp. 1-3.

V T Kalinin et al. "Theory and Practice of Cast-Iron Inoculation by Ultra- and Nanodispersed Materials", http://metaljournal.com.ua/assets/Uploads/attachments/Kalinin341.pdf, Jan. 1, 2010, p. 341-347; XP55128013.

* cited by examiner

INOCULANT WITH SURFACE PARTICLES

TECHNICAL FIELD

The present invention relates to an inoculant product for treating cast-iron, and to a method for manufacturing said inoculant.

BACKGROUND

Cast-iron is an iron-carbon alloy, well-known and widely used for the manufacture of mechanical parts. Cast-iron is obtained by mixing the constituents of the alloy in the liquid state at a temperature comprised between 1135° C. and 1350° C. before casting in a mold and cooling of the obtained alloy.

During its cooling, carbon may adopt different physico-chemical structures depending on several parameters.

When carbon is associated with iron and forms iron carbide $Fe_3C$ (also called cementite), the resulting cast-iron is called white cast-iron. White cast-iron is characterized in that it is hard and brittle, which is not desirable for some applications.

If carbon appears in the form of graphite, the resulting cast-iron is called gray cast-iron. Gray cast-iron is softer and may be worked.

In order to obtain cast-iron parts having good mechanical properties, it is therefore necessary to obtain a cast-iron structure comprising as much as possible carbon in the form of graphite and limit as much as possible the formation of these iron carbides which harden and embrittle the alloy.

In the absence of any particular treatment, carbon tends, nonetheless, to be associated with iron so as to form iron carbide.

Hence, it is necessary to treat the cast-iron in the liquid state so as to modify the association parameters of carbon and obtain the desired structure.

To this end, the liquid cast-iron undergoes an inoculation treatment aiming to introduce, in the cast-iron, graphitizing compounds which will promote, when the cast-iron is cooling in the mold, the apparition of graphite rather than iron carbide.

In general, the compounds of an inoculant are elements which promote the formation of graphite during the solidification of the cast-iron. For example carbon, silicon, calcium, aluminum, etc.

Of course, an inoculant may also be designed so as to fulfill other functions and, to this end, comprise other compounds having a particular effect.

In particular, depending on the required properties, it may be desired that the formed graphite is spheroidal, vermicular or lamellar. Either one of the graphitic forms can be obtained preferably by a particular treatment of the cast-iron by means of specific compounds. Thus, for example, the formation of spheroidal graphite may be promoted by a treatment called nodularizer treatment mainly aiming to provide the cast-iron with enough amount of magnesium so that graphite may grow so as to form rounded particles (spheroids).

For example, these nodularizer compounds may be included in the inoculant alloy.

We can also mention the addition of desulfurizing products, or products that allow treating specifically some defects of the cast-iron depending on the initial composition of the liquid cast-iron bath, such as micro shrinkage cavities, likely to appear during cooling. In particular, it may consist of lanthanum and rare-earth elements.

These treatments may be performed at once or in several times and at different moments during the manufacture of the cast-iron. In particular, it is known to add the inoculant in the ladle, prior to the casting of the cast-iron in the mold (ladle inoculation), during casting, or still in the casting jet (late inoculation).

Most inoculants are conventionally manufactured from a $FeSi_{65}$- or $FeSi_{75}$-type ferrosilicon alloy with the adjustment of the chemistry according to the aimed composition of the inoculant. The adjustment is possible in furnace or in ladle, with usually poor efficiencies, depending on the elements to be added. It may also consist of mixtures of several alloys.

It should be noted that the inoculation effectiveness of the cast-iron part also depends on its thickness.

In areas with small thicknesses, which cool more quickly, a higher risk of carbides formation will be noted.

Conversely, in areas with larger thicknesses, cooling will be slower and will promote the formation of graphite. Nonetheless, in parts with large thicknesses, cooling may be too slow and the formed graphite may lose its nodularity in the vicinity of the center of the part.

As a result, parts having areas with different thicknesses can have different physico-chemical structures from one area to another, which is not desirable.

BRIEF SUMMARY

Hence, there is a need for an inoculant which allows inoculating cast-iron parts with different thicknesses by limiting the risk of degeneration of graphite and the formation of carbides, and which allows ensuring a good uniformity of the metallurgical structure from one area of the part to another.

Moreover, it is also desirable that the inoculant has a very low sensitivity to the basic composition of the cast-iron which may vary from one batch to another (in particular, the initial carbon, silicon and sulfur rates, etc.)

In addition, it goes without saying that it is desirable that such an inoculant does not require an addition rate higher than the known products and that it preserves good dissolving properties in the cast-iron which are similar to these products, and that it does not generate substantially more drosses and slags than the latter.

To do so, the present invention aims to propose a new inoculant product for treating the liquid-phase cast-iron, which meets all or part of these constraints. To this end, it provides a powdered particle inoculant comprising, on the one hand, support particles made of a fusible material in the liquid cast-iron, and on the other hand, surface particles made of a material that promotes the germination and the growth of graphite, disposed and distributed in a discontinuous manner at the surface of the support particles, the surface particles presenting a grain size distribution such that their diameter (d50) is smaller than or equal to one-tenth of the diameter (d50) of the support particles.

Thus disposed, the surface particles form a discontinuous coating, while the support particle still presents areas in contact with the cast-iron.

The surface particles may be disposed at the surface of the support particles by any suitable technique, for example, by grafting, bonding, coating, provided that, for the support particle, the access to the liquid cast-iron is preserved when the inoculant is incorporated.

As indicated before, the surface particles have a grain size distribution smaller than that of the support particles. Indeed, it has been unexpectedly observed that such a configuration, namely a set of support particles partially coated with surface particles of a different nature such as a different grain size distribution, presents a dissolution and inoculation profile which addresses the aforementioned problems. The difference of nature between the support particles and the surface particles may further be expressed in the constitutive materials of the particles, respectively.

In particular, it has been observed that such a physico-chemical structure strongly limits the degeneration of graphite at the center of parts with high thicknesses. Such a structure also allows improving significantly the inoculation homogeneity, and more particularly, for parts presenting areas with different thicknesses.

Moreover, compared to a conventional manufacturing technique which comprises alloying into the furnace, since the inoculant effect is provided by the support particles/particles set disposed on the surface and not by adjustment of the chemical composition of an alloy, the incorporation efficiencies of the added elements are considerably improved.

According to a first embodiment, the support particles have poor inoculant properties. Thus, thanks to the invention, it is possible to use poor or moderate inoculant products which may be doped with this means.

According to a second embodiment, the support particles have inoculating properties for compositions or conditions different from those for which the support particles and surface particles set act.

Advantageously, the support particles are made from silicon, whose proportion is variable and which may reach 100% by mass relative to the mass of the support particles.

In a complementary or alternative manner, the support particles can be made from carbon, whose proportion is variable and which may reach 100% by mass relative to the mass of the support particles. If appropriate, the carbon is in the form of graphite. When associated with silicon, it may be, for example, in the form of silicon carbide.

Still advantageously, the support particles contain at least 40% by mass of silicon relative to the mass of the support particles.

Preferably, the support particles are made from an alloy, more particularly, from a ferrous alloy.

Advantageously, the support particles comprise, in particular in an alloyed form, at least one additive element, such as aluminum or calcium, in particular between 0.2 and 5% by mass for each additive element, relative to the mass of the support particles.

Still advantageously, the support particles comprise, in particular in an alloyed form, at least one element for treating shrinkage cavities, in particular in an amount comprised between 0.5 and 6% by mass, relative to the mass of the support particles.

Preferably, the proportion of the surface particles is comprised between 1 and 8% by mass, preferably from 1 to 5% by mass, relative to the mass of the inoculant.

Advantageously, the surface particles are distributed in a substantially homogeneous manner to the surface of the support particles, in particular within a batch of particles.

Preferably, until the introduction of the cast-iron, the surface particles occupy between 80 and 90% of the surface of the support particles.

Advantageously, the surface particles are chosen, separately or in a mixture, among metallic elements, such as aluminum, bismuth and manganese, silicides, in particular iron sillicides, rare earth silicides and calcium silicides, oxides, such as aluminum oxides, calcium oxides, silicon oxides or barium oxides, metallic sulfides, in particular iron sulfides, calcium sulfides and rare earth sulfides, sulfates, in particular barium sulfates, and carbon black.

The invention also concerns a method for manufacturing an inoculant of the invention. According to a first step of the method, there are provided, on the one hand, support particles made of a fusible material in the liquid cast-iron presenting a grain size distribution ranging from 0.2 to 7 mm, and on the other hand, surface particles presenting a grain size distribution such that their diameter d50 is smaller than or equal to one-tenth of the diameter d50 of the support particles, and then, in a second step, the surface particles are deposited on the support particles. This step may be implemented by any technique well known by those skilled in the art.

With the grain size distribution ranges from 0.2 to 7 mm, the conventional grain size distributions within the field of the cast-iron inoculants are included, namely the grain size distributions: 0.2-0.5 mm, 0.4-2 mm and 2-7 mm.

In one variant of the invention, the deposition of the surface particles is carried out mechanically, by inlay. To this end, the support particles and the surface particles are dry-mixed, at high speed, for example at a speed ranging from 1000 to 1500 rpm, so as to obtain a deposit by inlaying the surface particles at the surface of the support particles, according to a discontinuous distribution.

In another variant of the invention, at the first step, a binder is further provided in a solvent, then at a second step, the support particles, the surface particles and the binder are mixed together, then the solvent is removed from the binder, for example by evaporation. As will be described in more detail, the support particles, the surface particles and the binder may be added at the same time or successively, in any order. For example, it is possible to mix the surface particles beforehand in the binder solution, to which the support particles are added afterwards.

An appropriate binder is advantageously chosen among organic and polymer binders, and in particular, among the polyvinyl alcohol (PVA), the carboxymethyl cellulose (CMC), the polyvinylpyrrolidone (PVP) and cement.

A preferred method of the invention comprises using support particles made of a FeSi material containing aluminum and calcium, and/or surface particles made of a material chosen among aluminum, bismuth, silicides, in particular iron sillicides, rare earth silicides and calcium silicides, oxides such as aluminum oxides, calcium oxides, silicon oxides or barium oxides, metallic sulfides, in particular iron sulfides, calcium sulfides and rare earth sulfides, sulfates in particular barium sulfates and carbon black.

BRIEF DESCRIPTION OF THE DRAWINGS

The present invention will be better understood upon reading the detailed description and the implementation examples that follow, with reference to the appended drawing wherein.

DETAILED DESCRIPTION

Figure 1:
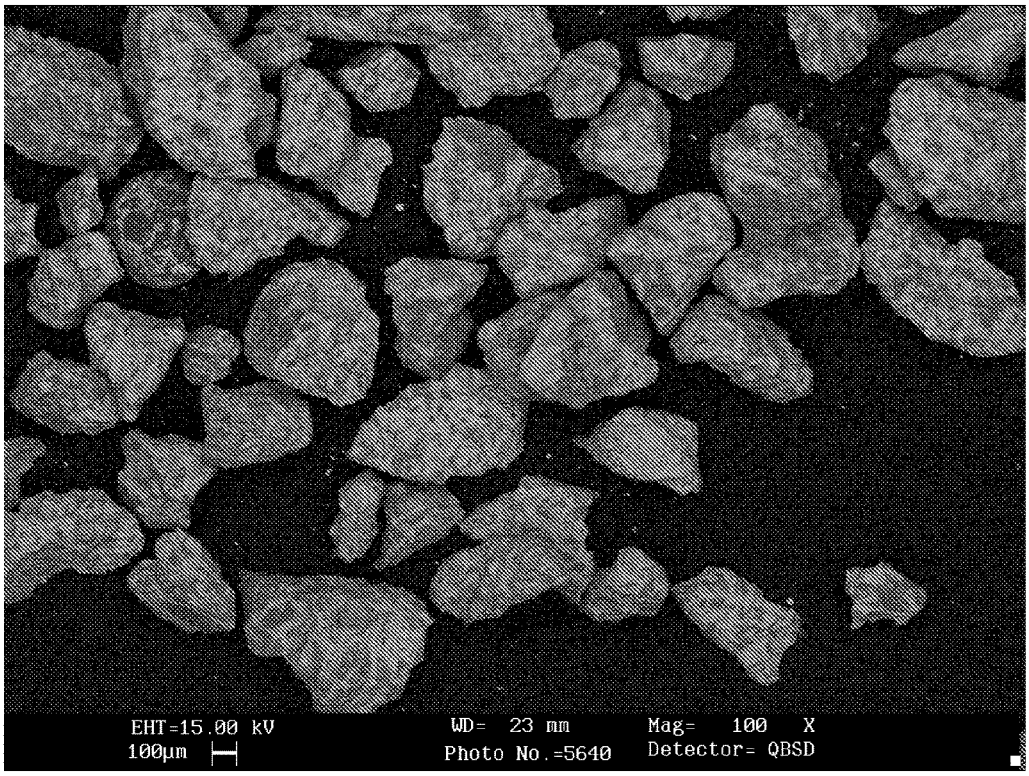
FIG. 1 is an overall view, taken from the scanning electron microscope, of a particulate inoculant batch according to the invention comprising support particles (black) to the surface of which are fixed the surface particles (white) conferring a high inoculating capacity to the entire set.
Figure 2:
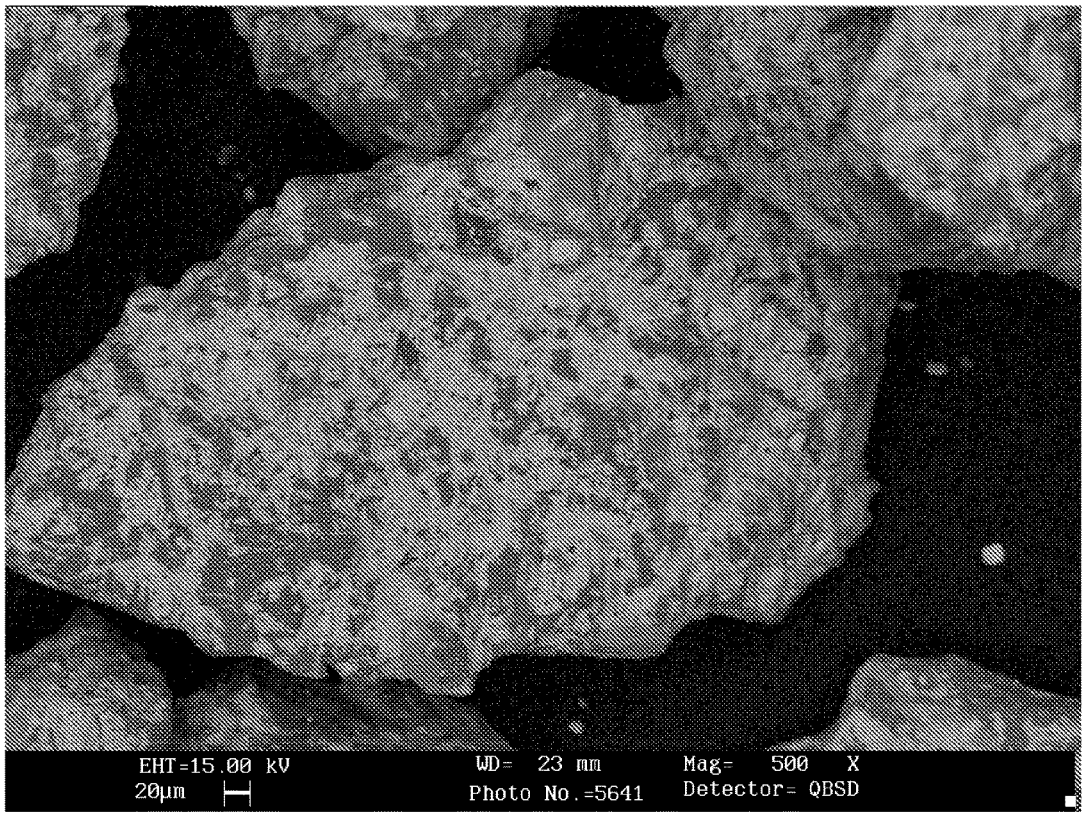
FIG. 2 is a zoom of FIG. 1 on an inoculating particle according to the invention.

An inoculant according to the invention can be manufactured in the following manner.

About 500 kg of a FeSi alloy containing 1% by mass of aluminum and 1.5% by mass of calcium and presenting a grain size distribution comprised between 0.4 to 2 mm, are introduced in a fluidized-bed reactor. The FeSi alloy being fluidized by air injection.

The minimum speed of fluidization is determined in the conventional way, then the air flow rate is kept substantially constant and higher than this minimum speed.

The temperature inside the reactor is raised to about 100° C. This temperature will enable the removal of the water injected subsequently.

The particles of this alloy will form the support particles to the surface of which will be fixed the inoculant particles.

In the present example, the surface particles may comprise calcium silicide (CaSi) and metallic aluminum particles both presenting grain size distributions smaller than 400 micrometers.

5% by mass of these surface particles will be used, namely about 25 kilograms of this mixture of CaSi and Al particles.

In order to allow their fixation on the support particles, the surface particles to be fixed are mixed beforehand with a binder in an aqueous solution, then injected in the reactor for about 30 minutes at the temperature of 100° C.

Once the mixture of particles and binder is completely injected, the surface particles, support particles and binder set are fluidized and heated until the complete evaporation of the introduced water. The water evaporation can be controlled by any common method, in particular by measuring the humidity of the air coming out of the reactor.

Afterwards, the inoculant of the invention is recovered and characterized in order to assess the effectiveness of the coating. In particular, this characterization can be carried out by monitoring with the scanning electron microscope.

The binder used can be of the organic or polymer type, such as for example binders of the type polyvinyl alcohol (PVA), carboxymethyl cellulose (CMC) and polyvinylpyrrolidone (PVP), etc. Of course, this list is not restrictive.

Of course, the amount of water used for diluting the binder depends on the solubility of the latter in water and should be adapted accordingly.

It is also possible to consider the use of mineral binders, in particular of the sodium silicate type, as well as hydraulic binders of the cement or lime type.

Of course, the nature of the used binder can depend on the supports and inoculant materials used.

The amount of binder used will be calculated so as to allow as best as possible the almost complete fixation of the surface particles with no significant excess which could afterwards damage the final performances of the inoculant according to the invention.

Of course, this used amount of binder will depend on its bonding capacity and should be also adapted accordingly. In particular, we can proceed by tests and visual checking, in particular by using a scanning electron microscope. Typically, the amount of binder used can be comprised between 0.001 and 1% by mass of binder, relative to the total mass of the particles (the support particles and the surface particles).

According to another possible example of inoculants manufacturing according to the invention, about 500 kg of $FeSi_{70}$ containing 1% by mass of Al and 1.5% by mass of Ca, with a grain size distribution comprised between 0.2 and 0.5 mm, are introduced in a fluidized-bed reactor. The FeSi alloy is fluidized by air injection. The temperature inside the reactor is raised to 100° C. These particles constitute the support particles. A suspension is made from PVP and water. 8% of surface particles, containing bismuth Bi and ferro-silico-rare earths FeSiRE alloy, both with a grain size distribution smaller than 200 μm, are added to the water+PVP solution, then put in suspension. Afterwards, this suspension is injected in an amount of 10% by mass in the reactor for about 40 min at a temperature of 100° C. When the mixture is completely injected, the temperature inside the reactor is maintained at 100° C. until the product is completely dried.

According to still another possible example of inoculant manufacturing according to the invention, about 1000 kg of $FeSi_{70}$ containing 1% by mass of Al and 1.5% by mass of Ca, with a grain size distribution comprised between 2 and 7 mm and about 50 kg of Aluminum powder with a grain size distribution smaller than 300 μm are introduced in a fluidized-bed reactor. All particles are fluidized by injection of depleted air. The temperature inside the reactor is raised to 100° C. A suspension is carried out with PVP and water. Afterwards, this suspension is injected in an amount of 10% by mass in the reactor for about 40 min at a temperature of 100° C. When the mixture is completely injected, the temperature inside the reactor is maintained at 100° C. until the product is completely dried.

Of course, the implementation of the method is not limited to the use of a fluidized-bed reactor and other coating techniques may be used. In particular, mention can be made to the following methods.

A first method comprises using a high-speed mixer, for example in the order of 1000 to 1500 rpm.

The mixing speed allows the mechanical inlaying of the fine surface particles in the particles larger than FeSi (support particles). Such a mechanical inlaying does not require the use of a binder and therefore, it is referred to as a cold and dry coating. The $FeSi_{75}$-type support particles containing mainly the $FeSi_{2,4}$ and Si phases, can be inlaid directly by the surface particles.

A second method comprises using a high-shear mixer.

In this case, the mixing is performed at a relatively high speed (for example between 50 and 500 rpm) in a mixer-granulator type mixer, in the presence of a binder (the aforementioned examples). After mixing, a drying step is carried out in order to remove the water from the binder.

The mixer may be equipped with drying means. In particular, these may comprise a burner manifold, for example gas burner manifold, which heat the exterior of the mixer by induction; of a heating belt, for example made of silica, surrounding in particular the walls of the mixer; or still of any other system that can raise the temperature of the powder inside the mixer to a temperature comprised between 80 and 150° C. in order to remove the water.

The mixing systems used, of the drum or granulator type, must enable a movement of the powder inside said mixer resulting to an effective stirring and a certain uniformity of the bonding.

To this end, the mixer may be equipped with stirring fins on its walls or still a mixer-granulator with a rotation system which is central or offset according to one or two axes.

The method of the invention may be carried out equally in a continuous or a discontinuous manner by batches.

During the implementation, the support and surface particles may be added either together or separately.

When they are added together, they can be advantageously premixed before adding the binder for ensuring the bonding.

When they are added separately, the support particles will be preferably introduced at first before adding the surface particles, preferably in a continuous manner, the binder being also introduced preferably in a continuous manner.

It should be also noted that, although the invention has been illustrated with FeSi-based support particles, it is of course possible to use other materials that are commonly used in the casting industry, and in particular support particles of the SiC or graphite type. If so, all it needs is to transpose the manufacture examples to these materials.

The results that have been achieved with such an inoculant according to the invention have been tested on a cast-iron bath.

As is the case with the manufacturing method, the examples are given for the most common cases of use with an inoculant according the invention whose support particle is of the FeSi type.

This is in no way preventing the use of inoculants according to the invention comprising other types of support particles such as silicon carbide or graphite, these materials being however less frequently used in the casting industry.

Example 1: Inoculant According to the Prior Art (Reference)

A spheroidal graphite cast-iron bath has been treated at a rate of 0.3% by weight with an inoculant alloy of the type $FeSi_{75}$ and containing 0.8% by mass of aluminum and 0.7% by mass of calcium.

The treatment is performed by adding the inoculant in the cast-iron ladle, before filling the mold.

The amount of equivalent carbon (Ceq) of the cast-iron is at 4.32% (calculated according to the simplified formula: Ceq=% C+⅓(% Si+% P) wherein % C, % Si and % P are the carbon, silicon and phosphorus contents of the cast-iron).

The residual magnesium of the cast-iron is at 400 thousandths.

Afterwards, the cast-iron has been cast in a BCIRA-type mold.

At a thickness of 6 mm, the treated cast-iron presents the following characteristics:

Structure of the matrix: 55% of pearlite, 15% of ferrite, 30% of cementite

Number of nodules per $mm^2$: 270

VI-type graphite: 57%

Average nodularity: 85%

Average diameter: 16.2 microns

Example 2: Inoculant According to the Invention

A spheroidal graphite cast-iron bath has been treated at a rate of 0.3% by mass with an inoculant according to the invention having the following composition:

Alloy of support particles: $FeSi_{75}$, and containing 0.8% by mass of aluminum and 0.7% by mass of calcium, Surface particles: 1.5% by mass of CaSi particles having a size smaller than 50 microns and 1.5% by mass of metallic aluminum particles having a size smaller than 50 microns, Binder: 10% by mass of an aqueous solution of PVP, Bonding deposit of surface particles carried out by fluidization at 100° C.

The treatment is performed by adding the inoculant in the cast-iron ladle, before filling the mold.

The amount of equivalent carbon (Ceq) of the cast-iron is at 4.32%.

The residual magnesium of the cast-iron is at 400 thousandths.

Afterwards, the cast-iron has been cast in a BCIRA-type mold.

At a thickness of 6 mm, the treated cast-iron presents the following characteristics:

Structure of the matrix: 45% of pearlite, 50% of ferrite, 5% of cementite

Number of nodules per $mm^2$: 540

VI-type graphite: 59%

Average nodularity: 92%

Average diameter: 18.7 μm

Example 3: Inoculant According to the Invention

A spheroidal graphite cast-iron bath has been treated at 0.3% by mass with a product constituted by:

a support alloy: $FeSi_{75}$ with Al=0.8% by mass and Ca=0.7% by mass, surface particles: 2.5% by mass of Bismuth Bi particles having a size <100 μm, and 2.5% by mass of particles of the ferrosilico-rare earths (FeSiRE) alloy having a size <100 μm, Binder: 10% by mass of an aqueous solution of PVP, Bonding deposit of surface particles carried out by fluidization at 100° C.

The treatment is performed by adding the inoculant in the cast-iron ladle, before filling the mold.

The amount of equivalent carbon (Ceq) of the cast-iron is at 4.32%. The residual magnesium is at 420 thousandths.

The cast-iron is cast in a BCIRA-type mold.

At the thickness of 6 mm, the cast-iron presents the following characteristics:

Structure of the matrix: 50% of pearlite, 50% of ferrite, 0% of cementite

Number of nodules per $mm^2$: 570

VI-type graphite: 62%

Average nodularity: 92%

Average diameter: 17.8 μm

Example 4: Inoculant According to the Prior Art

A spheroidal graphite cast-iron bath has been treated at a rate of 0.3% by mass with a $FeSi_{75}$-type inoculant elaborated in the conventional way and containing 1.2% by mass of aluminum, 1.5% by mass of calcium and 1.5% by mass of zirconium.

The treatment is performed by adding the inoculant in the cast-iron ladle, before filling the mold.

The amount of equivalent carbon (Ceq) of the cast-iron is at 4.32%.

The residual magnesium of the cast-iron is at 400 thousandths.

Afterwards, the cast-iron has been cast in a BCIRA-type mold.

At a thickness of 6 mm, the treated cast-iron presents the following characteristics:

Structure of the matrix: 45% of pearlite, 50% of ferrite, 5% of cementite

Number of nodules per $mm^2$: 505

VI-type graphite: 59%

Average nodularity: 87%

Average diameter: 18.9 microns

Thus, in order to obtain substantially the same results, it would be necessary to increase considerably the amounts of inoculating components and introduce zirconium, compared to an inoculant having a structure according to our invention, Example 5: Inoculant According to the Prior Art A lamellar graphite cast-iron bath has been treated at a 0.3% by weight with a $FeSi_{75}$-based product with Al=1.0% by weight and Ca=1.5% by weight.

The treatment is performed by adding the inoculant in the cast-iron ladle, before filling the mold.

The amount of equivalent carbon (Ceq) of the cast-iron is at 4.3%.

The cast-iron is cast in a BCIRA-type mold.

At the thickness of 6 mm, the cast-iron presents the following characteristics:

Number of eutectic cells/mm$^2$: 0.2

Cementite: 40%

Example 6: Inoculant According to the Invention

A lamellar graphite cast-iron bath has been treated at 0.3% by mass with a product constituted by:

a support alloy: $FeSi_{75}$ with Al=1.0% by mass and Ca=1.5% by mass.

surface particles: 5% by mass of barium sulfate $BaSO_4$ particles having a size <100 μm, a binder: 5% by mass of an aqueous solution of cement, a bonding deposit of surface particles carried out by fluidization at 100° C.

The treatment is performed by adding the inoculant in the casting ladle before filling the mold.

The amount of equivalent carbon (Ceq) of the cast-iron is at 4.3%.

The cast-iron is cast in a BCIRA-type mold.

At the thickness of 6 mm, the cast-iron presents the following characteristics:

Number of eutectic cells per mm$^2$: 2

No cementite

Example 7: Inoculant According to the Prior Art

A lamellar graphite cast-iron bath has been treated at 0.3% by mass with a $FeSi_{75}$-based product with Al=1.0% by mass, Ca=1.5% by mass and Zr=1.5% by mass.

The treatment is performed by adding the inoculant in the cast-iron ladle before filling the mold.

The amount of equivalent carbon (Ceq) of the cast-iron is at 4.3%.

The cast-iron is cast in a BCIRA-type mold.

At the thickness of 6 mm, the cast-iron presents the following characteristics:

Number of eutectic cells per mm$^2$: 1.5

Cementite: 5%

Example 8: Parts with Different Thicknesses—Inoculant According to the Invention A spheroidal graphite cast-iron bath has been treated at 0.3% by mass with a product constituted by:

a support alloy: $FeSi_{75}$ with Al=1.0% by mass and Ca=1.0% by mass, surface particles: 5% of a mixture of aluminum powders (size <75 μm) and CaSi (size <75 μm), Binder: 2% by mass of an aqueous solution of PVP, Bonding deposit of surface particles is carried out by fluidization at 100° C.

The treatment is performed by adding the inoculant to the jet when filling the mold.

The amount of equivalent carbon (Ceq) of the cast-iron is at 4.32%.

Afterwards, the cast-iron is cast in a mold intended for manufacturing a part having different thicknesses: 4 mm and 25 mm.

On the cast part, on the 4 mm-thick portion, the cast-iron presents the following characteristics:

Number of nodules per mm$^2$: 502

Average diameter: 17 μm

VI-type graphite: 85%

Nodularity: 98%

Cementite: 0%

Ferrite: 48%

Pearlite: 52%

On the cast part, on the 25 mm-thick portion, the cast-iron presents the following characteristics:

Number of nodules/mm$^2$: 250

Average diameter: 23 μm

VI-type graphite: 87%

Nodularity: 98.5%

Cementite: 0%

Ferrite: 50%

Pearlite: 50%

Example 9: Parts with Different Thicknesses—Inoculant According to the Prior Art A spheroidal graphite cast-iron bath has been treated at 0.3% by mass with a $FeSi_{75}$ alloy obtained in the conventional manner, containing 1.0% of Al, 1.0% of Ca and 1.5% by mass of Zr.

The treatment is performed by adding the inoculant to the jet when filling the mold.

The amount of equivalent carbon (Ceq) of the cast-iron is at 4.31%.

Afterwards, the cast-iron is cast in a mold intended for manufacturing a part having different thicknesses: 4 mm and 25 mm.

On the cast part, on the 4 mm-thick portion, the cast-iron presents the following characteristics:

Number of nodules/mm$^2$: 350

Average diameter: 19 μm

VI-type graphite: 70%

Nodularity: 95%

Cementite: 30%

Ferrite: 40%

Pearlite: 30%

On the cast part, on the 25 mm-thick portion, the cast-iron presents the following characteristics:

Number of nodules/mm$^2$: 150

Average diameter: 25 μm

VI-type graphite: 73%

Nodularity: 95.5%

Cementite: 0%

Ferrite: 50%

Pearlite: 50%

Thus, it is possible with the inoculants, according to the invention, to effectively inoculate the different portions of a part having different thicknesses, while it can be hardly achieved with an inoculant manufactured according to the prior art.

Example 10: Large-Thickness Parts—Inoculant According to the Invention

A spheroidal graphite cast-iron bath has been treated at 0.3% by mass with a product constituted by:

a support alloy: $FeSi_{75}$ with Al=1.0% by mass and ca=1.0% by mass, surface particles: 5% of a mixture of aluminum powders (size <75 μm) and of CaSi (size<75 μm), Binder: 10% by mass of an aqueous solution of cement, Bonding deposit of surface particles carried out by fluidization at 100° C.

The treatment is performed by adding the inoculant in the casting bath during the filling of the mold.

The amount of equivalent carbon (Ceq) of the cast-iron is at 4.33%.

Afterwards, the cast-iron is cast in a mold intended for manufacturing a large-thickness part (170 mm).

On the 170 mm-thick cast part, at the center of the part, the cast-iron presents the following characteristics:

Number of nodules/mm$^2$: 160
VI-type graphite: 65%
Average diameter: 25 μm
Nodularity: 99.2%
Cementite: 0%
Ferrite: 50%
Pearlite: 50%

Example 11: Large-Thickness Parts—An Inoculant According to the Prior Art

A spheroidal graphite cast-iron bath has been treated at 0.3% by mass with a $FeSi_{75}$ alloy obtained in the conventional manner, containing 1.0% of Bi, and 0.6% of rare earth elements.

The treatment is performed by adding the inoculant in the casting bath during the filling of the mold.

The amount of equivalent carbon (Ceq) of the cast-iron is at 4.31%.

Afterwards, the cast-iron is cast in a mold intended for manufacturing a large-thickness part: 170 mm.

On the cast part, at the middle of the 170 mm-thick part, the cast-iron presents the following characteristics:

Number of nodules/mm$^2$: 155
Average diameter: 22 μm
VI-type graphite: 50%
Nodularity: 85%
Cementite: 0%
Ferrite: 52%
Pearlite: 48%

Thus, it is possible with the inoculants, according to the invention, to effectively inoculate large-thickness parts, while preserving a good nodularity of the graphite.

Although the invention has been described with a particular embodiment, it goes without saying that it is not limited thereto and that it comprises all technical equivalents of the described means, as well as their combinations if these are within the scope of the invention.

The invention claimed is:

1. A powdered particulate inoculant for treating liquid cast-iron, comprising:

support particles made of a fusible material in the liquid cast-iron, and surface particles made of a material that promotes germination and growth of graphite, disposed and distributed in a discontinuous manner at a surface of the support particles, wherein the support particles comprise at least a ferro-silicon alloy, aluminum and calcium, wherein silicon is present in at least 40% by mass to the mass of said support particles, and aluminum and calcium are present in an alloyed form and each in amount of between 0.2 and 5% by mass relative to the mass of the support particles, the material of the surface particles is different from the material of the support particles, and the surface particles present a grain size distribution such that their diameter d50 is smaller than or equal to one-tenth of a diameter d50 of the support particles, and wherein, until an introduction of the cast-iron, the surface particles occupy up to 90% of the surface of the support particles.

2. The inoculant according to claim 1, wherein the support particles are made of a material that promotes the association of carbon with iron in the form of graphite.

3. The inoculant according to claim 1, wherein the support particles comprise, in an alloyed form, at least one additive element between 0.2 and 5% by mass for each additive element, relative to the mass of the support particles.

4. The inoculant according to claim 1, wherein the support particles comprise, in an alloyed form, at least one element for treating shrinkage cavities, in an amount comprised between 0.5 and 6% by mass, relative to the mass of the support particles.

5. The inoculant according to claim 1, wherein a proportion of the surface particles comprises between 1 and 8% by mass, relative to a mass of the inoculant.

6. The inoculant according to claim 1, wherein, until an introduction of the cast-iron, the surface particles occupy between 80 and 90% of the surface of the support particles.

7. The inoculant according to claim 1, wherein the surface particles comprise at least one of, separately or in a mixture, metallic elements including aluminum, bismuth and manganese, silicides including iron silicides, rare earth silicides and calcium silicides, oxides including aluminum oxides, calcium oxides, silicon oxides or barium oxides, metallic sulfides including iron sulfides, calcium sulfides and rare earth sulfides, barium sulfates and carbon black.

8. The inoculant of claim 7, wherein the surface particles comprise at least one of aluminum oxides, calcium oxides, silicon oxides, barium oxides, and barium sulfate.

9. The inoculant according to claim 1, wherein the surface particles are inlaid in the surface of the support particles.

10. The inoculant according to claim 1, wherein the surface particles are bonded by means of a binder at the surface of the support particles.

11. A method of manufacturing an inoculant for treating liquid cast-iron according to claim 1, comprising:

providing support particles made of a fusible material in the liquid cast-iron, presenting a grain size distribution ranging from 0.2 to 7 mm, providing surface particles presenting a grain size distribution such that their diameter d50 is smaller than or equal to one-tenth of a diameter d50 of the support particles, and dry mixing the support particles and the surface particles at high speed so as to obtain a deposit by inlaying the surface particles at the surface of the support particles, according to a discontinuous distribution.

12. The method according to claim 11, wherein the surface particles are made of a material comprising at least one of aluminum, bismuth, silicides including iron silicides, rare earth silicides and calcium silicides, oxides including aluminum oxides, calcium oxides, silicon oxides or barium oxides, metallic sulfides including iron sulfides, calcium sulfides and rare earth sulfides, sulfates including barium sulfates and carbon black.

13. The method of manufacturing an inoculant according to claim 1, further comprising:

providing support particles made of a fusible material in the liquid cast-iron, presenting a grain size distribution ranging from 0.2 to 7 mm, and providing surface particles presenting a grain size distribution such that their diameter d50 is smaller than or equal to one-tenth of the diameter d50 of the support particles, providing a binder in a solvent, mixing the support particles, the surface particles and the binder, to obtain a deposit by binding the surface particles at the surface of the support particles, according to a discontinuous distribution and removing the solvent from the binder.

14. The method according to claim 13, wherein the binder comprises at least one of organic and polymer binders including polyvinyl alcohol (PVA), carboxymethyl cellulose (CMC), polyvinylpyrrolidone (PVP), and cement.

15. A powdered particulate inoculant for treating liquid cast-iron, comprising:

support particles made of a fusible material in the liquid cast-iron, comprising at least a ferro-silicon alloy, aluminum and calcium, wherein silicon is present in at least 40% by mass to the mass of said support particles, and aluminum and calcium are present in an alloyed form and each in amount of between 0.2 and 5% by mass relative to the mass of the support particles, and surface particles made of a material that is different from the material of the support particles, and that promotes the germination and the growth of graphite, disposed and distributed in a discontinuous manner at a surface of the support particles, wherein the support particles present a grain size distribution ranging from 0.2 to 7 mm, wherein the surface particles present a grain size distribution such that their diameter d50 is smaller than or equal to one-tenth of a diameter d50 of the support particles, and wherein, until an introduction of the cast-iron, the surface particles occupy up to 90% of the surface of the support particles.

16. The inoculant of claim 15, wherein the surface particles comprise at least one oxide or a sulfate.

17. The inoculant of claim 16, wherein said oxide is selected from the group consisting of aluminum oxides, calcium oxides, silicon oxides, and barium oxides; and said sulfate is a barium sulfate.

* * * * *